US006786367B2

(12) United States Patent
Schlösser

(10) Patent No.: US 6,786,367 B2
(45) Date of Patent: Sep. 7, 2004

(54) FILLING SLEEVE

(75) Inventor: Werner Schlösser, Hennef (DE)

(73) Assignee: BHM Chronos Richardson, GmbH, Hennef (DE)

( * ) Notice: Subject to any disclaimer, the term of this patent is extended or adjusted under 35 U.S.C. 154(b) by 0 days.

(21) Appl. No.: 10/367,081

(22) Filed: Feb. 14, 2003

(65) Prior Publication Data

US 2003/0154689 A1 Aug. 21, 2003

(30) Foreign Application Priority Data

Feb. 16, 2002 (DE) ..... 202 02 372 U

(51) Int. Cl.[7] ..... B65B 1/04

(52) U.S. Cl. ..... 222/478; 222/460; 141/236; 141/286; 141/391; 93/2 R; 93/14; 93/29

(58) Field of Search ..... 141/234, 236, 141/240, 244, 286, 390, 391; 252/460, 462, 478; 193/2 R, 3, 4, 7–9, 14, 28, 29

(56) References Cited

U.S. PATENT DOCUMENTS 407,907 A * 7/1889 Sprague ..... 366/181.5
578,985 A * 3/1897 Grove ..... 141/240
829,839 A * 8/1906 Brownell ..... 222/276
969,376 A * 9/1910 Kiely ..... 141/238
1,198,092 A * 9/1916 Wilhelm et al. ..... 209/137
1,668,825 A * 5/1928 Sobek ..... 414/586
2,155,336 A * 4/1939 Smith ..... 141/240
2,783,898 A * 3/1957 Ardern et al. ..... 193/2 R
2,874,736 A * 2/1959 Hughes ..... 141/234
3,324,905 A * 6/1967 Paulo ..... 141/100
6,053,220 A * 4/2000 Lo et al. ..... 141/129
6,126,375 A * 10/2000 O'Brien ..... 414/299

FOREIGN PATENT DOCUMENTS

GB 2239852 * 7/1991 ..... B65B/1/04

* cited by examiner

*Primary Examiner*—J. Casimer Jacyna

(57) ABSTRACT

The present invention provides a filling sleeve which allows containers with a rectangular or square cross-section, especially bags with deep side folds, to be filled advantageously in that they are given a stable shape. The objective is achieved by means of a filling sleeve which is characterized in that, in the exit cross-section, a central region is provided with inserts and four separate exit apertures are kept open in the corners of the square or rectangular cross-section. In this way, the filling material flowing through the substantially completely open and normally undivided entrance cross-section of the filling sleeve is divided into four individual streams which are associated with the corners of the exit cross-section. Thus, while being filled, the bags are initially stabilized from the corners, as a result of which a certain tension remains in the walls between the corners, so that the walls cannot bulge out when the level of the filling material rises. The effect is the same, both on bags clamped to the filling sleeve and on bags standing on a base. The filled bags comprise a stable rectangular or square cross-sectional shape, so that, after the bags have been filled and released from the filling sleeve, the edges of the bag flaps are positioned largely parallel relative to one another, thus allowing simple and uncomplicated closing operations.

11 Claims, 1 Drawing Sheet

FILLING SLEEVE

FIELD OF INVENTION

The invention relates to a filling sleeve to be attached to a charging cone for bulk material, having an arbitrary entrance cross-section and a square or rectangular exit cross-section, for filling containers with a square or rectangular cross-section, in particular for filling clamped-on bags with side folds.

BACKGROUND OF THE INVENTION

Filling sleeves of this type are used to adapt the cross-section of the filling device to the cross-section of the container, i.e. the exit cross-section of the filling device largely has to correspond to the entrance cross-section of the container which has to be filled and which, normally, is formed by a bag attached by external clamping devices to the filling sleeve. As a rule, the filling sleeves can easily be separated from the charging cone in order to be able to attach the filling sleeves which match different bag shapes and bag sizes. The entrance cross-section can be arbitrary, i.e. it can be either circular or square for example.

When filling the attached bags with material after the lock aperture in the charging cone above has been opened, the filling material preferably flows centrally into the bag which, initially, still comprises its square or rectangular shape predetermined by the exit cross-section of the filling cone. However, because the bag is filled centrally, it has a tendency to bulge out or acquire a round shape because the conically accumulating material initially applies a load to the bag wall centers. In particular, this applies to granular filling materials with bad flow properties. Such a round bag—after having been released by the clamping devices—is difficult to close because the edges of the bag flap are no longer positioned parallel relative to one another, as was the case while the bag was being attached to the filing sleeve. Apart from the problems involved in closing the bag, bags with a round shape are disadvantageous in that they can no longer be stacked densely and securely on pallets.

OBJECT OF THE INVENTION

It is therefore the object of the present invention to provide a filling sleeve which allows containers with a rectangular or square cross-section, especially bags originally having deep side folds, when folded flat to be filled advantageously in that they are given a stable shape. The objective is achieved by means of a filling sleeve which is characterized in that, in the exit cross-section, a central region is provided with inserts and four separate exit apertures are kept open in the corners of the square or rectangular cross-section. In this way, the filling material flowing through the substantially completely open and normally undivided entrance cross-section of the filling sleeve is divided into four individual streams which are associated with the corners of the exit cross-section. Thus, while being filled, the bags are initially stabilized from the corners, as a result of which a certain tension remains in the walls between the corners, so that the walls cannot bulge out when the level of the filling material rises. The effect is the same, both on bags clamped to the filling sleeve and on bags standing on a base. The filled bags comprise a stable rectangular or square cross-sectional shape, so that, after the bags have been filled and released from the filling sleeve, the edges of the bag flaps are positioned largely parallel relative to one another, thus allowing simple and uncomplicated closing operations. The closed bags can be stacked one above the other in a compact and secure way, and there remain very few dead spaces.

The built-in inserts in the exit cross-section of the filling sleeve have to be such that no filling material can be deposited thereon and that there is no interference in the flow of filling material due to excessive cross-sectional narrowing.

SUMMARY OF FIRST PREFERRED EMBODIMENT

According to a first preferred embodiment, it is proposed that in the exit cross-section is a symmetrically cruciform surface provided with inserts and four identically dimensioned square or rectangular exit apertures kept free in the corners. In particular, it is proposed that two wedge elements which intersect each other in a cross-like way, are pointed towards the top and are inserted into the filling sleeve respectively centrally in the filling sleeve and so as to extend parallel to the edges of the filling sleeve. In the case of a rectangular exit cross-section one of the wedge elements may be wider and higher than the other one, whereas in the case of a square exit cross-section, identically designed wedge elements are advisable. The wedge angle in both cases can be acute, i.e. an amount to 30° for example. In particular, the wedge angle has to be such that the wedge flanks are positioned parallel to the diverging walls of the lower portion of the filling sleeve. In this way it is possible to avoid cross-sectional narrowing which may lead to blockages in the material flow.

SUMMARY OF A SECOND EMBODIMENT

According to a second concrete embodiment, it is proposed that in the exit cross-section, a symmetrically arranged, cross-wise positioned square or diamond-shaped surface, be provided with inserts and four identically dimensioned triangular exit apertures are kept open in the corners of the rectangular cross-section. In particular, it is proposed that a straight pyramid with a square or rectangular base and an upwardly directed point be inserted centrally into the filling sleeve and corner-wise relative to the exit cross-section. A further addition which serves to hold the pyramid in the sleeve and to separate the material streams can consist in that between the pyramid edges and the centers of the filling sleeve walls there are inserted vertical separating plates. In particular, the latter are essential for compensating purposes if a pyramid on a square base is inserted into a rectangular exit cross-section. It is appreciated that, in consequence, in respect of the exit apertures referred to as being triangular, the triangle points positioned in the center of each filling sleeve wall are cut off by a small amount. In this embodiment, the point of the pyramid can optionally project upwardly beyond the narrowest cross-section of the filling sleeve.

In both embodiments, the filling sleeve preferably forms an upper portion with a constant cross-section or a cross-section converging from the top to the bottom thereof, and a lower portion with a constant cross-section or a cross-section which diverges from the top to the bottom thereof. In particular, the structures are built up upwardly on the exit plane of the filling sleeve. In the case of filling sleeves for small filling quantities, it is advantageous for the structures to comprise a short height above the exit plane, which height corresponds to only half the height of the lower portion. The inserts can be plate metal structures which open downwardly. In all cross-sections of the filling sleeve, the outer edge ratio does preferably not greatly differ from 1.

Two preferred embodiments of the invention are illustrated in the drawings and will be described below.

DETAILED DESCRIPTION OF THE INVENTION

Figure 1:
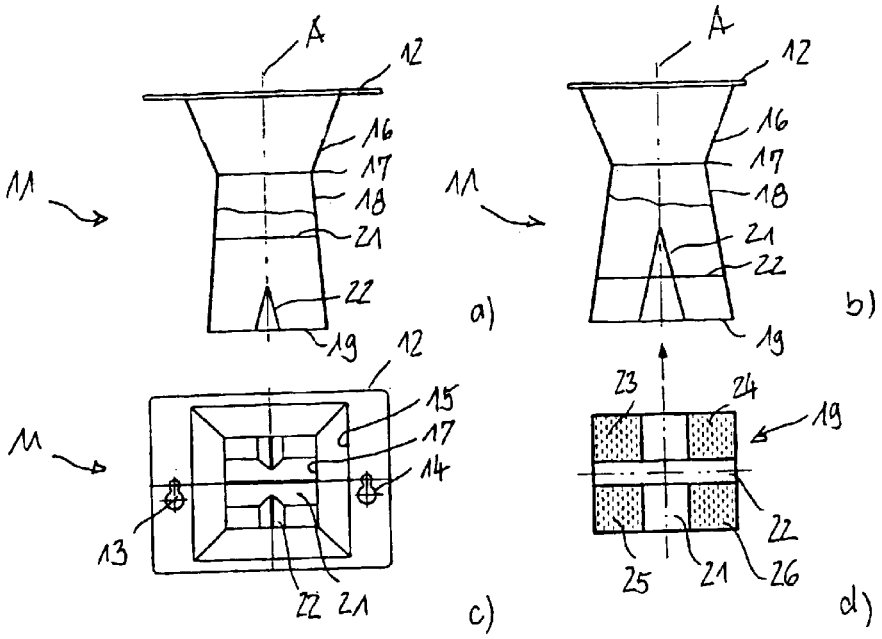
FIG. 1*a* shows a first side view of an inventive filling sleeve with a cruciform built-in structure.
FIG. 1*b* shows a second side view of the filling sleeve of FIG. 1*a*.
FIG. 1*c* shows a plan view of the filling sleeve of FIG. 1*a*.
FIG. 1*d* shows a view, from below, of the exit cross section of the filling sleeve of FIG. 1*a*.

FIG. 1 shows a filling sleeve 11 which comprises a vertical sleeve axis A, with the following details being identifiable. An upper flange 12 comprises a basic rectangular shape and is provided with two fixing holes 13, 14 for attaching the flange and bolting the flange to the counter flange of a charging cone from which a measured quantity of filling material flows through the filling sleeve 11 into a container positioned underneath or attached, especially a bag with side folds. The flange 12 with a square entrance aperture 15 is followed by an upper portion 16 of the filling sleeve which, from said square entrance aperture 15, converges towards a narrowest intermediate cross-section 17 which is also square in shape. This is followed by a lower portion 18 of the filling sleeve which widens from said intermediate cross-section 17 into a rectangular exit cross-section 19. In the upper portion 18 there is provided a built-in structure with a cruciform basal area which, while being built up on the exit cross-section, consists of a large first wedge element 21 bisecting the longer axis of the exit cross-section, and of a second wedge element 22 which is less high and which bisects the shorter axis of the exit cross-section. The two wedge elements intersect each other and are inserted symmetrically with an upwardly directed wedge point with a wedge angle of approximately 30°. The plan view of FIG. 1*c* of the built-in structure shows that the two wedge elements penetrate one another. In the view of FIG. 1*d* from below of the exit aperture it can be seen that the second wedge element 22 in the form of a one-piece plate metal angle, is inserted into the first wedge element 21 which is provided with cut-outs and which also consists of a one-piece plate metal angle. The ratio of the basal areas of the wedge elements and thus, with predetermined identical wedge angles, also the ratio of the heights is thus that in the four corners of the rectangular exit cross-section, there remain free four square exit apertures 23, 24, 25, 26. The stream of filling material is thus divided into four individual streams which flow into the outermost corners of the attached bag and from there are able to flow towards the center, so that first the basic rectangular shape of the attached bag is stabilized, with the tendency of the bag to form a round shape as a result of the in-flowing filing material being suppressed.

Figure 2:
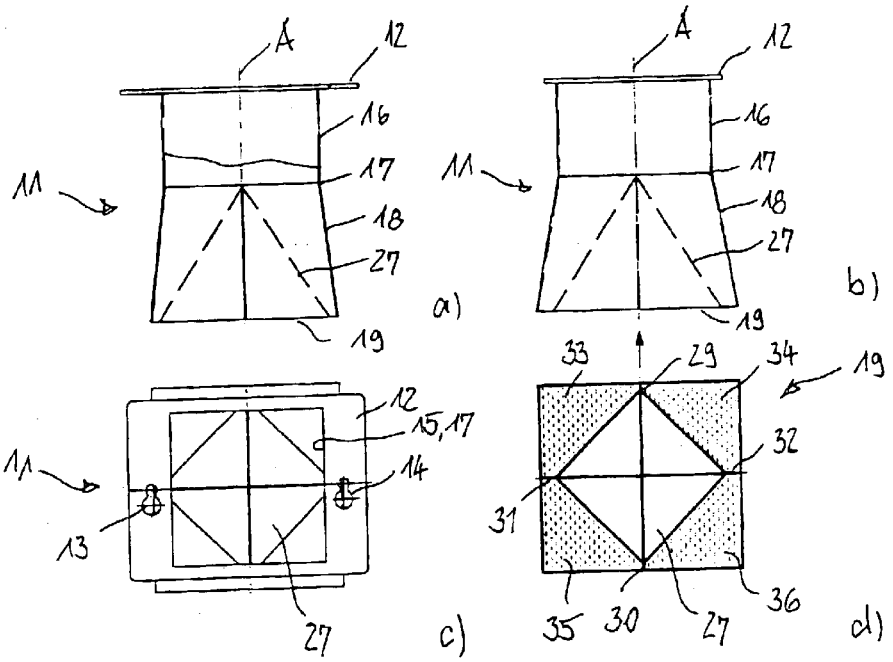
FIG. 2*a* shows in a first side view the inventive filling sleeve in a second embodiment with a square built-in structure.
FIG. 2*b* shows a second side view of the filling sleeve of FIG. 2*a*.
FIG. 2*c* shows a plan view of the filling sleeve of FIG. 2*a*.
FIG. 2*d* shows a view, from below, of the exit cross-section of the filling sleeve of FIG. 2*a*.

FIG. 2 shows a filling sleeve 11 which comprises a vertical sleeve axis A, with the following details being identifiable. An upper flange 12 comprises a basic rectangular shape and is provided with two fixing holes 13, 14 for attaching the flange and bolting the flange to the counter flange of a charging cone from which a measured quantity of filling material flows through the filling sleeve 11 into a container positioned underneath or attached, especially a bag with side folds. The flange 12 with a square entrance aperture 15 is followed by an upper portion 16 of the filling sleeve which, from said square entrance aperture 15 converges, approximately unchanged, towards a narrowest intermediate cross-section 17 which is also square in shape. This is adjoined by a lower portion 18 of the filling sleeve, which lower portion 18 widens from said intermediate cross-section 17 to form a rectangular exit cross-section 19. In the lower portion 18, there is provided a built-in structure with a square basal area which is arranged corner-wise relative to the exit cross-section and which, while being built up on the exit cross-section, consists of a straight pyramid member 27 with an upwardly directed point. The point angle of the pyramid as measured between two edges amounts to approximately 60°. The central position of the pyramid point can be seen in the plan view of the built-in structure. In the view, from below, of the exit aperture it can be seen that the pyramid has been inserted in the form of a plate metal structure which is open at its bottom end. The distance between the pyramid edges and the filling sleeve walls is bridged by connecting plates 29, 30, 31, 32 which can extend from the exit aperture 19 to the level of the transition cross-section 17. In the four corners of the rectangular exit cross-section 17 there remain, in this embodiment, four triangular exit regions 33, 34, 35 36 whose points are cut off by a small amount by connecting plates. The stream of filling material is thus divided into four individual streams which flow into the outermost corners of the attached bag and from there, are able to flow back into the center of the bag, so that, initially, the rectangular basic shape of the attached bag is stabilized, with the tendency of the bag to form a round shape as a result of the in-flowing filling material being suppressed.

What is claimed is:

1. A filling sleeve for attachment to a charging cone for bulk material, having an arbitrary entrance cross-section and a square or rectangular exit cross-section, for filling containers with a square or rectangular cross-section wherein said exit cross-section has a central region provided with inserts forming four separate exit apertures open at the corners of said square or rectangular exit cross-section and wherein two wedge elements which intersect each other in a cross-like way and are pointed up towards the said entrance cross section are inserted centrally into said filling sleeve so as to extend parallel to the edges of said filling sleeve.

2. A filling sleeve according to claim 1, wherein in said exit cross-section said inserts form a symmetrical cruciform area and leave open four identically dimensioned square or rectangular exit apertures open at said corners of said exit cross-section.

3. A filling sleeve according to claim 1, wherein one of said wedge elements is higher toward said entrance cross-section than the other of said wedge elements.

4. A filling sleeve according to claim 1, wherein the wedge angles of both of said wedge elements are identical, at approximately 30°.

5. A filling sleeve for attachment to a charging cone for bulk material, having an arbitrary entrance cross-section and a square or rectangular exit cross-section, for filling containers with a square or rectangular cross-section wherein said exit cross-section has a central region provided with inserts forming four separate exits apertures open at the corners of said square or rectangular exit cross-section and wherein in said exit cross-section said inserts form a symmetrically arranged, corner-wise positioned square or diamond-shaped area and leave open four identically dimensioned triangular exit apertures in the corners of said exit cross-section.

6. A filling sleeve according to claim 5, wherein said inserts are in the form of a straight pyramid with a square or diamond-shaped base and having a point upward directed toward sail entrance cross section, is inserted centrally into said filling sleeve and corner-wise relative to said cross-section.

7. A filling sleeve according to claim 5, wherein between edges of said pyramid and the centers of the filling sleeve walls, there are inserted vertical connecting plates.

8. A filling sleeve according to claim 1 or 5 wherein said filling sleeve comprises an upper portion whose cross-section is constant from the top to the bottom thereof or converges, and a lower portion whose cross-section is constant or diverges from the top to the bottom thereof.

9. A filling sleeve according to claim 1 or 5, wherein said inserts are positioned in said lower portion below said upper portion and are built up on the exit cross-section plane.

10. A filling sleeve according to claim 1 or 5, wherein said inserts in said filling sleeve are plate metal structures which open downwardly toward said exit cross-section.

11. A filling sleeve according to claim 1 or 5, wherein all cross-sectional areas in the filling sleeve are square or comprise an edge ratio close to 1.

* * * * *